United States Patent [19]

Allen et al.

[11] Patent Number: 4,602,394

[45] Date of Patent: Jul. 29, 1986

[54] BABY BATHER

[76] Inventors: Christina L. Allen, 108 Sandringham Rd., Rochester, N.Y. 14610; Mark Flanagan, 183 Travis Dr., Pittsburgh, Pa. 15236; Michael P. Kind, 436 Rockledge Ave., Huntingdon Valley, Pa. 19006

[21] Appl. No.: 687,840

[22] Filed: Dec. 31, 1984

[51] Int. Cl.[4] ..... A47K 3/164

[52] U.S. Cl. ..... 4/659; 4/572

[58] Field of Search ..... 4/559, 571–577, 4/580, 584–587, 641, 659, 654

[56] References Cited

U.S. PATENT DOCUMENTS

| | | | |
|---|---|---|---|
| 1,167,849 | 1/1916 | Sherman . | |
| 1,545,446 | 7/1925 | Paulet | 4/572 |
| 2,491,223 | 12/1949 | Stadlman . | |
| 2,507,848 | 5/1950 | Bashaw | 4/572 |
| 2,724,839 | 11/1955 | Kennedy . | |
| 2,736,904 | 3/1956 | Suggs | 4/577 |
| 2,907,051 | 10/1959 | Phillips | 4/585 |
| 2,972,752 | 2/1961 | Rudolf | 4/585 |
| 3,037,216 | 6/1962 | Stringer . | |
| 3,209,374 | 10/1965 | Walz . | |
| 3,319,265 | 5/1967 | Losada . | |
| 3,392,408 | 7/1968 | Stiphany . | |
| 4,065,660 | 12/1977 | Berard . | |
| 4,123,809 | 11/1978 | Pugh . | |
| 4,128,686 | 12/1978 | Kyle et al. . | |
| 4,216,552 | 8/1980 | Gurolnick . | |
| 4,330,887 | 5/1982 | White . | |

*Primary Examiner*—Stephen Marcus
*Assistant Examiner*—Linda J. Sholl
*Attorney, Agent, or Firm*—William L. Krayer

[57] ABSTRACT

A light, portable, flexible vessel for bathing babies is disclosed, comprising a rigid but impact-absorbent frame adapted to be placed on and around the periphery of a conventional kitchen sink, and a removable, slip-on fabric pouch suspended therefrom and secured with a "Velcron"-type seal. The pouch is characterized by cut-offs on at least one corner and preferably is of double thickness, i.e. a sack which will easily slip over the frame.

3 Claims, 3 Drawing Figures

BABY BATHER

BACKGROUND OF THE INVENTION

Figure 1:
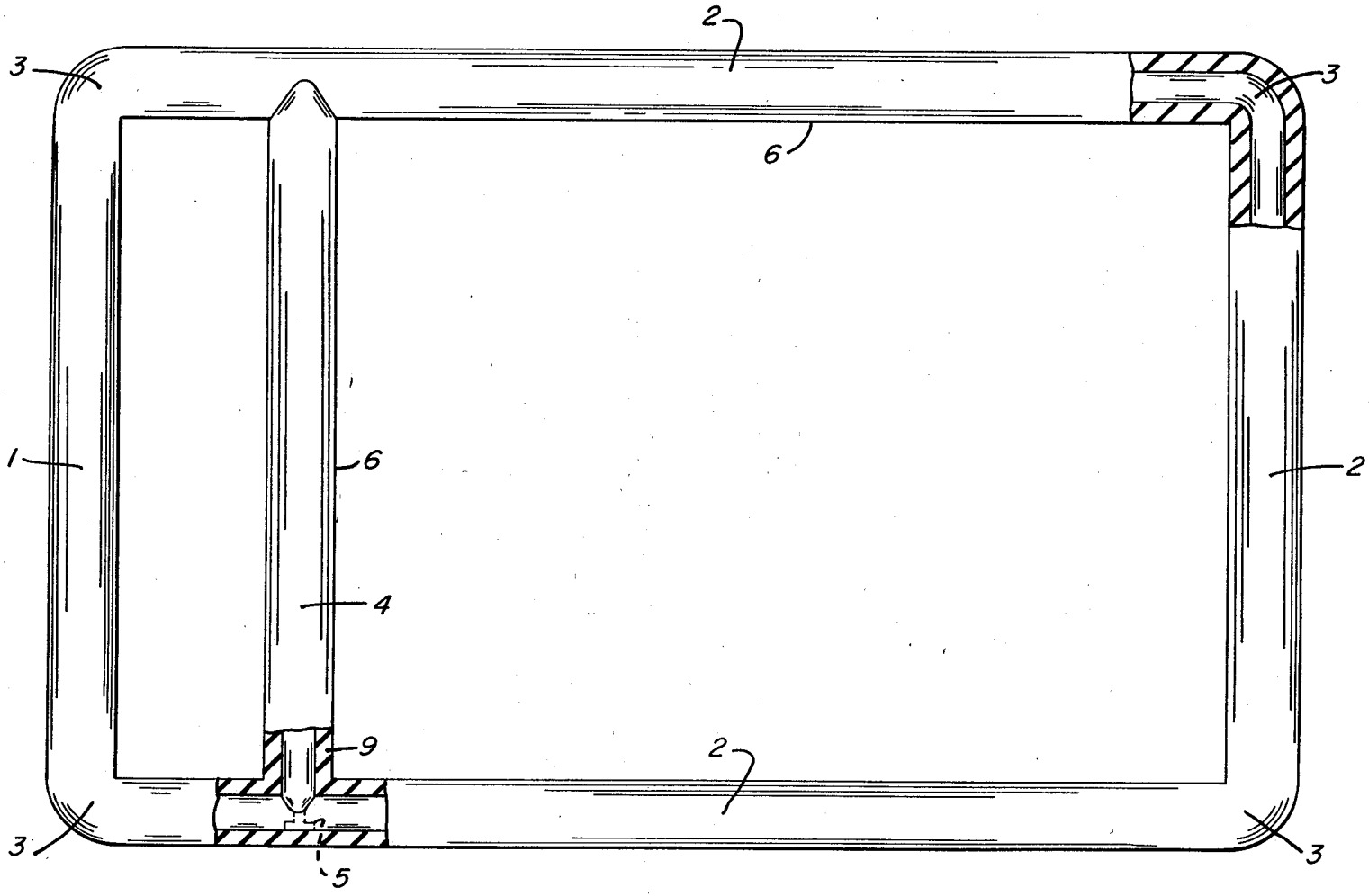

The bathing of small babies, i.e. those of less than ten months of age and especially under six months requires a great deal of care and attention not only to clean and rinse, but also constantly to hold and stabilize them so they do not fall or slip. Many mothers bathe their babies in the kitchen sink because, being at arm level, they may be readily attended. Even in the kitchen sink, however, a baby who cannot sit erect for long unattended must normally be held constantly to prevent injury or submersion. It is especially difficult for an arthritic or handicapped person to hold the baby steady and bathe him or her at the same time. A number of workers in the art have attempted in the past to design safe and convenient devices or appliances which may be used by the mother in the bathtub or kitchen sink to help support a small child during bathing. For example, Walz, in U.S. Pat. No. 3,209,374, depicts an adjustable frame on which a baby bathtub or bathinette is to be placed for securing it to the top of a full-size bathtub. Stiphany discloses a similar bathing "tray" in U.S. Pat. No. 3,392,408. Sherman, in U.S. Pat. No. 1,167,849, illustrates a frame which may be folded for convenient storage, the frame being of a size for spanning a bathtub and having on it a "membrane" or sling in which the baby is suspended. See also Stadlman, U.S. Pat. No. 2,491,223, also emphasizing the storability of his design, and which is particularly adapted for use on a sink rather than a bathtub, and Pugh U.S. Pat. No. 4,123,809, for an infant's bath comprising a "rubberized fabric" suspended on a frame supported by folding legs; an elaboration of this approach is shown by Kennedy in U.S. Pat. No. 2,274,839. The reader may also be interested in comparing the infant carrier for an automobile disclosed by Stringer in U.S. Pat. No. 3,037,216, and the foldable infant's bath which is permanently attached to the wall above the standard tub, disclosed by Losada in U.S. Pat. No. 3,319,265.

Perhaps more nearly addressing the problems which we have faced is Gurolnick in U.S. Pat. No. 4,216,552—the bottom of the tray which supports the baby is designed to fit over and be restrained by the divider of a double sink so that it will not slip. As will be seen in the description below, we employ sponge rubber of the closed cell type as a coating on our frame to prevent it from slipping; while sponge rubber has been used, for example, as a pad in the "central recessed area" of Stiphany, and also by Pugh in a slightly different context, we are not aware of the use of sponge rubber to perform the dual purpose of preventing slippage of the frame and also cushioning the infant's head. Moreover, we have not discerned in the prior art a sling, trough, or pouch adapted to be so easily removed for cleaning as ours—it is sealed entirely with elements on the sling itself and no manipulation of the frame is required to remove it as in many of the above configurations. The "Velcro" seal we employ has been suggested for securing a pair of terry cloth gloves to be used in bathing infants—see U.S. Pat. No. 4,330,887 to White. The reader may also be interested in reviewing Kyle's U.S. Pat. No. 4,128,686, Parker U.S. Pat. No. 4,230,364 and Berard U.S. Pat. No. 4,065,660 mentioned below in the description of FIG. 2.

SUMMARY OF THE INVENTION

We have invented a simple, easily stored, easily cleaned device in which to bathe an infant, which does not require constant vigilance against the possibility that the infant will fall or slip. When placed in our infant bather, the infant cannot fall, and will remain steady in a sitting position as the water fills the vessel. Our bather also has the advantage that the temperature of the running water may be tested while the baby is secured in the bather, yet before the water touches the baby. An additional attribute of our invention is that, once placed on the sink, it will not slip. Another is that its frame is covered with padding or foam so the baby's head will not be injured if it strikes the frame, and in fact the head may be leaned against the frame without fear of injury. Another feature of our invention is that the vessel may be drained easily without having to pick it up, and it is impossible to overfill. Still another feature of our invention is that, although the fabric vessel is waterproof, it may be easily removed and laundered.

Our invention comprises a rigid frame having a padded or sponge rubber overlay, the frame being of a rectangular size and shape adapted to rest on top of an ordinary kitchen sink, and a waterproof fabric bag or pouch of a size and shape adapted to slip over the frame and be easily sealed along its opening. The pouch must be of a size and shape to contain the baby, i.e. so that after sealing it will contain about one-half to about three gallons of water in a more or less hemispherical shape. The seal is preferably a "Velcro" seal. The frame preferably has an additional transverse member in order to permit an open space for water to be directed from the faucet for temperature testing.

Figure 2:
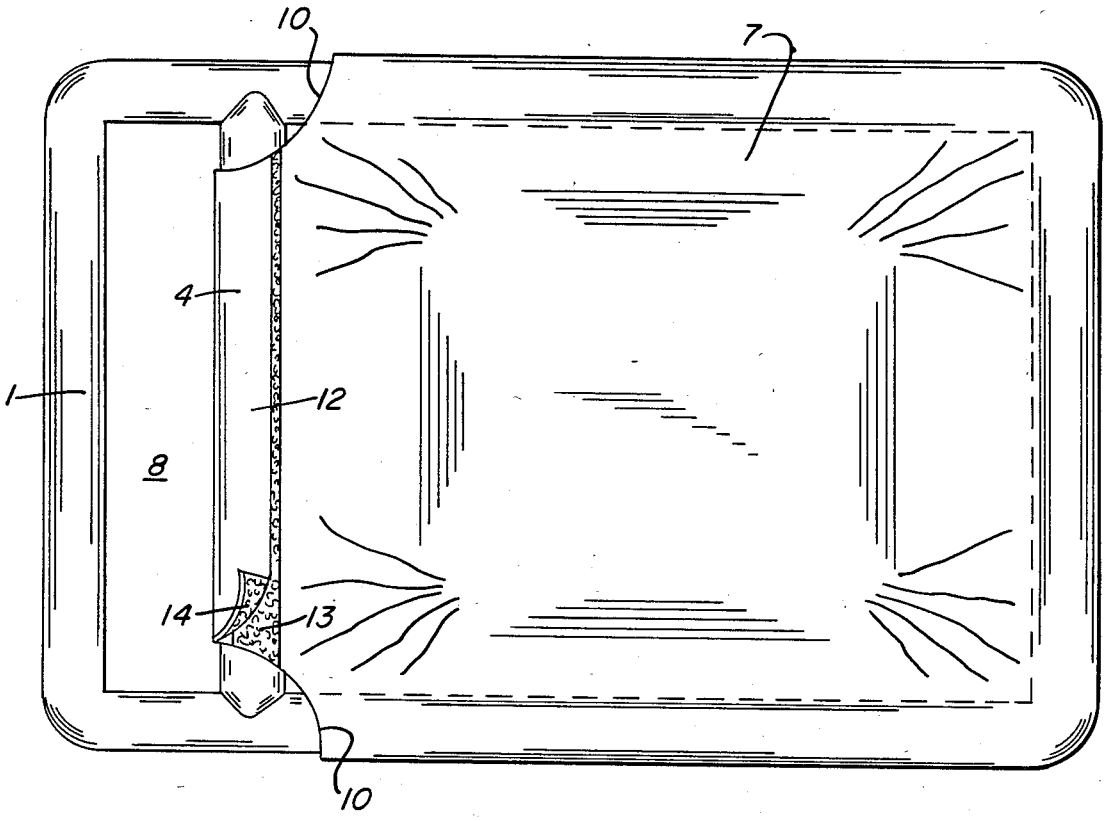
Figure 3:
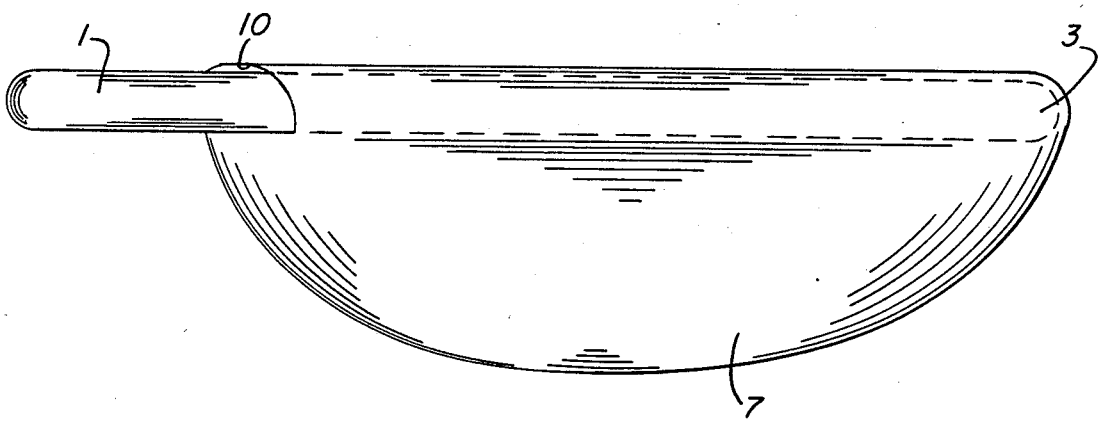

Our invention will be more particularly described with reference to the accompanying drawings, in which FIG. 1 is an overhead view of the frame of our unit, FIG. 2 is a perspective view of the assembled unit, and FIG. 3 is a front view.

Referring first to FIG. 1, the preferred frame may desirably be about twenty-eight by about seventeen inches overall, in order to be placed on a more or less standard kitchen sink, although it may vary considerably in either direction, bearing in mind that there must be sufficient space within the frame for a baby; the frame in FIG. 1 has an extra transverse member 1. The frame comprises rigid tubular or bar members 2 which are covered with sponge rubber 9 or other foam or padding. The rigid bars or tubes 2 may be metallic or plastic, and may be bent in a conventional manner at corners 3. The interior transverse member 4 may be secured by bolts 5 or in any other suitable manner. The sponge rubber 9 or padding may preferably be covered with a skin 6 to render it impervious to water.

In FIG. 2, the fabric bag or pouch 7 is shown in place over the frame. The extra transverse member 1 is, however, not covered, leaving a space 8 through which water from the faucet may pass. While a waterproof fabric material is preferred for the pouch or bag 7, it may also be made of plastic sheet and may even be disposable; however, it is essential that a seal or other fastening means 12 be provided along its opening so that it may be attached to the transverse member 4. A "Velcro" seal or a similar seal having mutually adhesive fiber surfaces 13 and 14 is preferred because the attachment may be secured with one hand. By a "Velcro" seal we mean a seal made of opposing hook and loop surfaces, now common in many appliances and the like. See, for example, col. 4, lines 49–63 of Berard U.S. Pat. No. 4,065,660 describing such a seal on a baby bottle warmer. The "Velcro" seal is also described in Parker's U.S. Pat. No. 4,230,364, which employs it in a chair for placing it in a wading pool.

The front view of the preferred embodiment illustrated in FIG. 3 shows the Frame 2 the extra transverse member 1, the sponge rubber 9 and the pouch 7. The preferred foam or sponge rubber for the frame covering is of the closed cell type in order to prevent the absorption of water, and may be applied to the frame in a conventional manner, i.e. by reaction injection molding.

We do not intend to be limited in our above invention to the above specific description and preferences. Our invention may be otherwise embodied and practiced within the scope of the following claims:

We claim:

1. A baby bather comprising a waterproof bag or pouch and a substantially rectangular frame adapted to be placed therein, said pouch or bag having fastening means on its open end for fastening it to the frame while the frame is in said bag or pouch, and said frame having a non-slip, padded exterior and being of a size and shape to rest on the periphery of a conventional kitchen sink so that, when said frame is in said bag or pouch and is resting on the periphery of a kitchen sink, the exterior of the bag or pouch will form a more or less hemispherical container, capable of holding water and a baby, suspended from said frame, said frame having an extra transverse member to form an open space between said extra transverse member and the end of the frame on which the bag or pouch is fastened, through which water may pass from a faucet while the bather is resting on the periphery of a kitchen sink, said transverse member being uncovered by said pouch or bag so that said non-slip padded exterior on the extra transverse member will contact the sink, thereby inhibiting slipping of the bather and providing protection against injury of an infant in said bather.

2. The baby bather of claim 1 wherein the fastening means extends over only a portion of the opening of said pouch or bag, so that water will drain therefrom at a point lower than said frame.

3. The baby bather of claim 1 in which the fastening means comprise a flap of a length sufficient to wrap around a portion of the frame, said fastening means including opposing hook and loop surfaces.

* * * * *